US005135208A

United States Patent [19]

Diskin

[11] Patent Number: 5,135,208

[45] Date of Patent: Aug. 4, 1992

[54] CHAIN GUIDE APPARATUS FOR A PIPE VISE

[75] Inventor: James W. Diskin, Denver, Colo.

[73] Assignee: Coors Brewing Company, Golden, Colo.

[21] Appl. No.: 594,099

[22] Filed: Oct. 9, 1990

[51] Int. Cl.[5] ..... B25B 1/04

[52] U.S. Cl. ..... 269/130

[58] Field of Search ..... 248/354.5, 354.6, 354.7; 269/70, 130–132, 254 CS, 902; 74/538, 575, 578

[56] References Cited

U.S. PATENT DOCUMENTS

| | | | |
|---|---|---|---|
| 406,935 | 7/1889 | Murphy | 74/578 |
| 1,365,892 | 1/1921 | Craver | 74/578 |
| 1,636,880 | 7/1927 | Tucker et al. | 269/130 |
| 2,648,242 | 8/1953 | Walter . | |
| 2,952,282 | 9/1960 | McHenry | 269/254 CS |
| 3,379,431 | 10/1965 | Gill . | |
| 3,480,270 | 11/1965 | Gill . | |

FOREIGN PATENT DOCUMENTS

| | | | |
|---|---|---|---|
| 14979 | 6/1956 | Fed. Rep. of Germany | 248/354.7 |

OTHER PUBLICATIONS

Pages 24–25 from Ridgid Tool Co. Catalog No. RT-580, Nov. 1989.

*Primary Examiner*—Robert C. Watson
*Attorney, Agent, or Firm*—Klaas, Law, O'Meara & Malkin

[57] ABSTRACT

An improved chain-type pipe vise system. The vise includes a base member, at least two V-shaped vise members, and a chain having one end attached to the base member. The other end is designed to wrap around a pipe, and extends downwardly beneath the base member to an attachment assembly. To engage the unattached end of the chain within the attachment assembly, a chain guide unit is mounted to the vise beneath the base member. The unit includes a tubular member having a rod slidably mounted therein. The rod includes an outwardly-extending section which is movable along a slot through the tubular member, and biasing means for pulling the section inwardly. In operation, the outwardly-extending section is drawn back and released. This enables the section to move inwardly, engaging the unattached end of the chain and urging it into the attachment assembly.

23 Claims, 2 Drawing Sheets

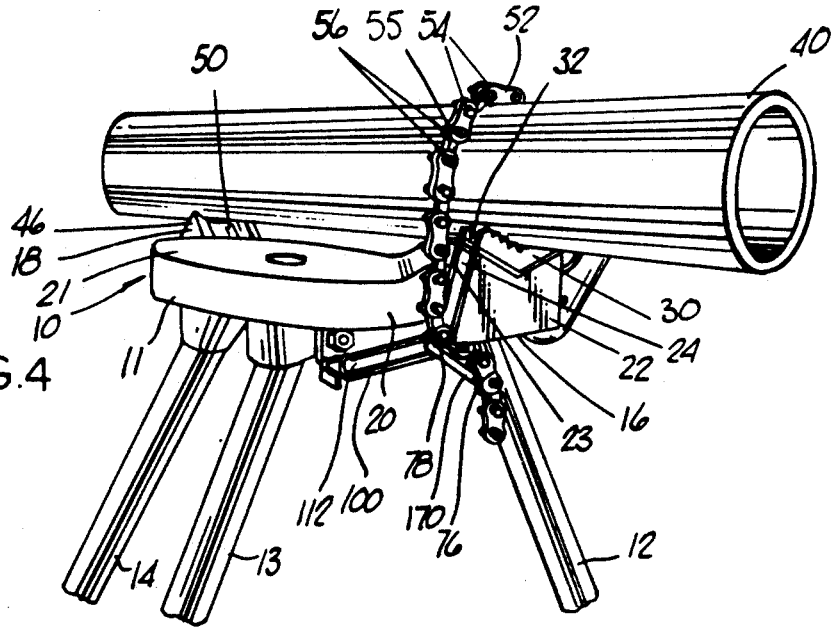
FIG.4
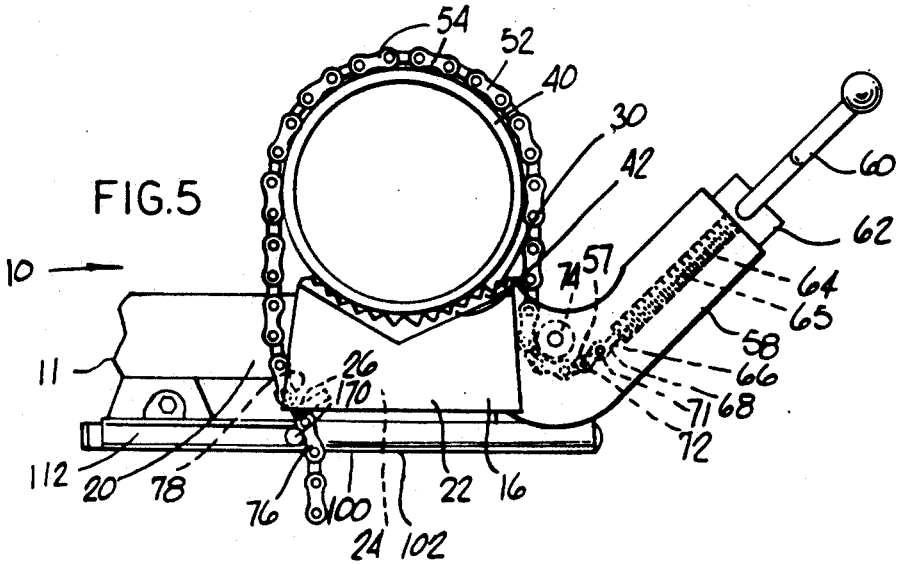
FIG.5
FIG.6
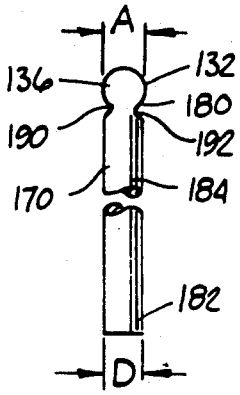
FIG.7
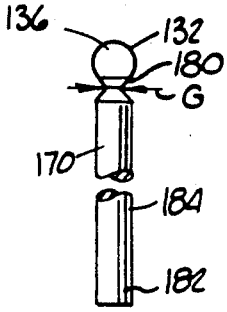
FIG.8
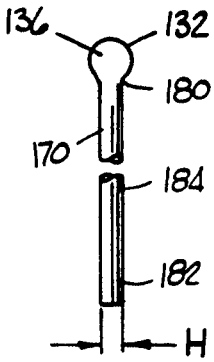

CHAIN GUIDE APPARATUS FOR A PIPE VISE

BACKGROUND OF THE INVENTION

The present invention generally relates to a pipe vise having a chain used to secure a pipe to the vise, and more particularly to a pipe vise having an attachment designed to facilitate engagement of the pipe by the chain in a rapid and efficient manner.

In the plumbing and general construction industries, it is usually necessary to work with large sections of heavy pipe. These sections must often be cut, welded, or the like prior to installation and use. In the past, it has been difficult to physically retain large sections of pipe in a fixed, convenient position so that they may be worked on. To solve this problem, pipe vise units have been developed which securely retain large sections of pipe in a fixed orientation during welding, cutting or other physical procedures.

Typical pipe vises include a base member (e.g. a flat platform) having multiple legs attached thereto. Positioned on the platform are at least two V-shaped vise members sized to receive pipe sections of varying diameter. Associated with one or more of the V-shaped members is a retaining chain. The chain has one end operatively secured to the platform, and is designed to wrap around a pipe after the pipe has been positioned on the V-shaped members. The chain also has a free end which ultimately hangs in a downward orientation beneath the platform. The free end of the chain is subsequently urged into an attachment assembly beneath the platform. Thereafter, the chain is tightened around the pipe, preferably using a crank-type apparatus known in the art. Exemplary pipe vise systems of this type are currently being manufactured and sold by the Ridgid Tool Company of Elyria, Ohio (model No. 450). In addition, typical chain-type pipe vise systems are also described in U.S. Pat. Nos. 2,648,242; 3,379,431; and 3,480,270.

The present invention involves an improved pipe vise system which greatly facilitates the secure attachment of a pipe thereto. Specifically, an apparatus for a chain-type pipe vise is provided which enables the free end of the chain to be engaged within the attachment assembly of the vise in a rapid and efficient manner.

SUMMARY OF THE INVENTION

It is an object of the present invention to provide a pipe vise system of improved design, operating efficiency, and safety.

It is another object of the invention to provide an improved pipe vise system which uses a chain to rapidly and effectively secure a pipe in position.

It is a further object of the invention to provide an improved chain-type pipe vise system which includes a subsystem designed to facilitate engagement of a pipe with the chain.

It is a still further object of the invention to provide an improved chain-type pipe vise system which includes a sub-system designed to automatically place the chain in a locked position around a pipe.

In accordance with the foregoing objects, an improved pipe vise is provided which enables the mounting of a pipe thereto in a rapid and efficient manner. The pipe vise includes a base member (e.g. a rigid platform) having a plurality of legs attached thereto. Secured to the platform are at least two V-shaped vise members sized to receive a pipe therein. A chain is also provided which is operatively attached at one end to the platform. The other end of the chain is designed to wrap around a pipe and extend downwardly beneath the platform. Ultimately, the unattached end is secured to an attachment assembly associated with the platform. Thereafter, the chain is tightened in a conventional manner around the pipe.

To facilitate engagement of the unattached end of the chain within the attachment assembly, a chain guide unit is mounted to the pipe vise beneath the support platform. The unit consists of a tubular member circular in cross section having a rod slidably mounted therein. The rod includes a first section and a second section. The first section is positioned entirely within the tubular member. The second section extends outwardly at an angle relative to the first section through a longitudinal slot in the tubular member. Movement of the first section within the tubular member causes corresponding movement of the second section longitudinally through the slot. The chain guide unit also includes biasing means (e.g. a spring) within the tubular member. The biasing member is designed to urge the second section of the rod inwardly along the slot toward the middle of the tubular member.

In operation, the second section of the rod member is pulled outwardly against the action of the biasing means within the tubular section. The second section is then locked so that is it maintained in an outward orientation. When the second section is oriented in this manner, the downwardly-extending, unattached end of the chain will be positioned adjacent to and slightly ahead of the second section. The second section of the rod is then released, causing the biasing means within the tubular member to pull the second section inwardly along the slot. As a result, the unattached end of the chain is urged by the second section of the rod into the attachment assembly of the pipe vise. This procedure is substantially superior compared with previous techniques which involved manual placement of the chain within the attachment assembly.

These and other objects, features, and advantages of the invention shall be described below in the following Brief Description of the Drawings and Detailed Description of Preferred Embodiments.

BRIEF DESCRIPTION OF THE DRAWINGS

Illustrative and presently preferred embodiments of the invention are shown in the accompanying drawings in which:

FIG. 4 is an enlarged front perspective view of the pipe vise and chain guide unit of FIG. 3 subsequent to the operation thereof.

FIG. 5 is a front elevational view of the pipe vise and chain guide unit of FIG. 4.

FIG. 6 is an enlarged front elevational view of the second section of the rod used in the chain guide unit of FIG. 1.

FIG. 7 is an enlarged front elevational view of an alternative embodiment of the second section of a rod used in the chain guide u it of FIG. 1.

FIG. 8 is an enlarged front elevational view of a further alternative embodiment of the second section of a rod used in the chain guide unit of FIG. 1.

DETAILED DESCRIPTION OF PREFERRED EMBODIMENTS

The present invention involves a special system for a chain-type pipe vise which enables the chain to be rapidly and efficiently secured against a pipe. The invention represents an advance in the art of pipe-handling technology, as described below.

Figure 3:
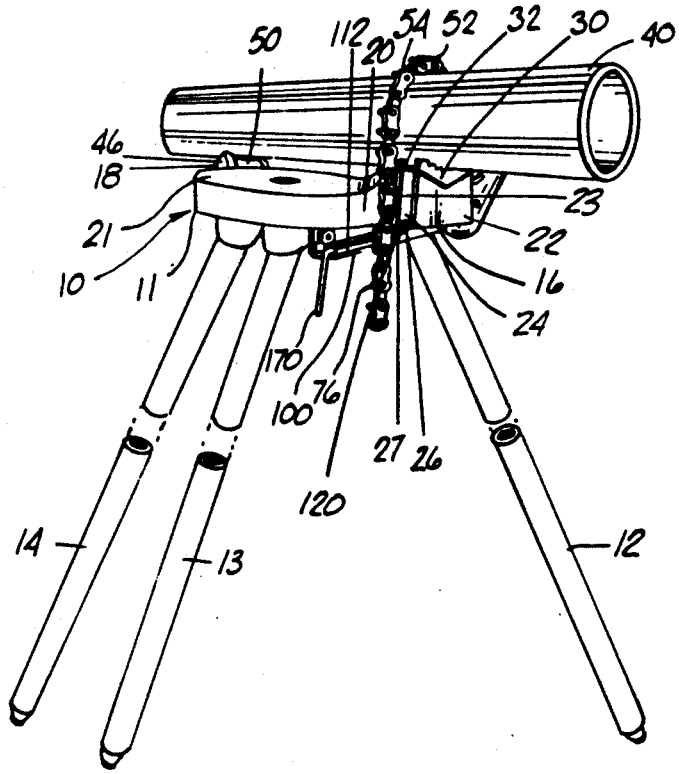
FIG. 3 is a front perspective view of a pipe vise having the chain guide unit of FIG. 1 attached thereto prior to the operation thereof.

With reference to FIGS. 3–5, a conventional pipe vise 10 is illustrated. The pipe vise 10 shown in FIGS. 3–5 is comparable to a vise manufactured by the Rigid Tool Company of Elyria, Ohio (model no. 450). However, it should be noted that the present invention shall not be limited to the use of the specific pipe vise 10 shown and described herein. In the alternative, the invention is prospectively applicable to other known pipe vise products produced by various manufacturers.

The pipe vise 10 includes a base member preferably in the form of a platform 11. Secured to the platform 11 are multiple legs 12, 13, 14 in a tripod configuration designed to maintain the entire pipe vise 10 in an upright position as illustrated. At least two vise members 16, 18 are attached to the platform 11 at the front and rear portions 20, 21, respectively. The vise member 16 actually consists of dual plates 22, 23 which are spaced apart from each other to form an open zone 24 therebetween. Positioned within the open zone 24 are dual engagement members 26, 27 (FIGS. 3 and 5) which extend outwardly from the plates 22, 23, respectively. The plates 22, 23 and the engagement members 26, 27 form the chain attachment assembly of the pipe vise 10, as described hereinafter.

At the top of each plate 22, 23, a V-shaped upper section 30, 32 is provided. The V-shaped upper sections 30, 32 are designed to receive a pipe 40 therein, and further include a plurality of gripping teeth 42 (FIG. 5) which securely maintain the pipe 40 in position. The vise member 18 at the rear portion 21 of the platform 11 consists of a single member 46 having a V-shaped upper section 50 thereon as illustrated.

With continued reference to FIGS. 3–5, the pipe vise 10 further includes a chain 52 having a plurality of links 54 (FIG. 4). Each of the links 54 includes pivot pins 55 having outwardly extending end portions 56 on both sides of the links 54. The chain 52 is designed to encircle the pipe 40 when positioned on the vise 10 (FIGS. 3–5). The chain 52 includes a first end 57 which is secured to and within a crank apparatus 58 of a type known in the art and illustrated in FIG. 5. The crank apparatus 58 is conventional, and is designed to exert a pulling force on the chain 52 when a handle 60 is rotated. Specifically, the handle 60 is attached to a collar 62 which is threadably mounted on a complementary threaded shaft 64 which is positioned within a threaded bore 65 in the apparatus 58. The shaft 64 has a terminal end 66 which includes a connecting portion 68 thereon. The connecting portion 68 has an opening therein (not shown) which is sized to receive a pin 71 in the end link 72 of the first end 57 of the chain 52. Also included adjacent the connecting portion 68 is a circular guide cam 74. Rotation of the handle 60 causes the shaft 64 to move inwardly or outwardly as desired which, in turn, tightens or loosens the chain 52 against the pipe 40.

The chain 52 also includes a second end 76 which is unattached as illustrated in FIGS. 3–5, and suspended in a downward configuration beneath the platform 11 after the chain 52 has been wrapped around the pipe 40.

In operation, the pipe 40 is positioned on the V-shaped upper sections 30, 32, 50 as illustrated in FIGS. 3–5. Thereafter, the chain 52 is wrapped around the pipe 40, followed by manual placement of the unattached end of the chain 52 within the open zone 24 between the plates 22, 23 of the vise member 16. Specifically, a portion 78 of the second end 76 of the chain 52 is placed within the open zone 24 between the plates 22, 23. The portion 78 of the second end 76 is then manually manipulated within the zone 24 so that the outwardly extending end portions 56 of on of the pins 55 of one of the links 54 is engaged beneath and against the engagement members 26, 27. Finally, the handle 60 of the crank apparatus 58 is rotated in order to tighten the chain 52 around the pipe 40.

However, manual placement of the portion 78 of the second end 76 of the chain 52 within the open zone 24 often proved to be difficult and time consuming. The chain guide unit of the present invention solves these problems as described below.

Figure 1:
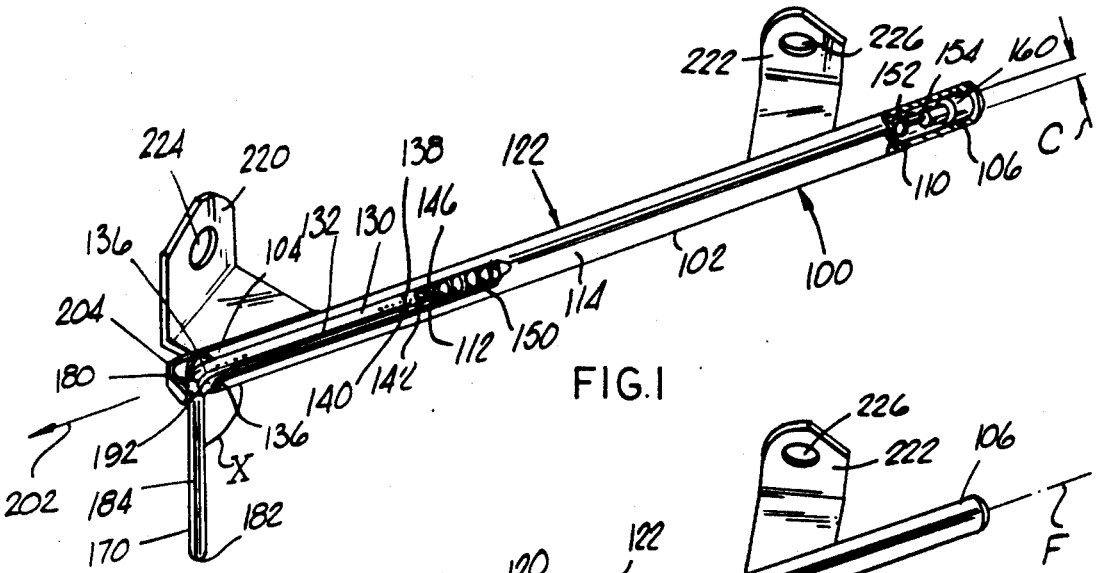
FIG. 1 is a front perspective view of chain guide unit for a pipe vise produced in accordance with the present invention prior to the operation thereof.
Figure 2:
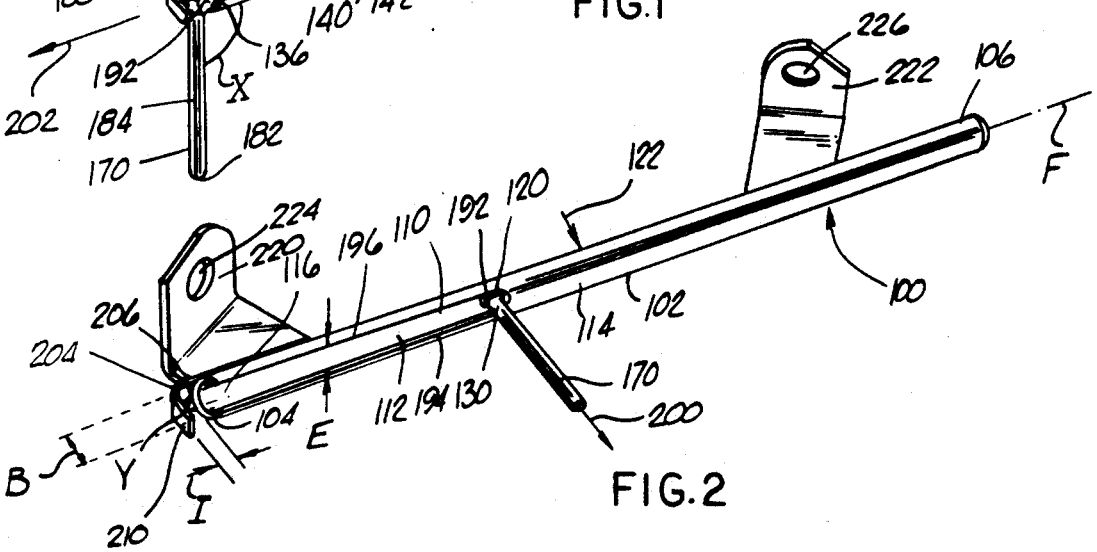
FIG. 2 is a front perspective view of the chain guide unit of FIG. 1 subsequent to the operation thereof.

A chain guide unit 100 produced in accordance with the invention is illustrated in FIGS. 1–2. The unit 100 (which is preferably manufactured of durable metal) includes a tubular member 102 having a first end 104 (which is open), a second end 106, and a continuous bore 110 therethrough. The tubular member 102 is preferably circular in cross section. Beginning at the first end 104 and extending inwardly is an elongate slot 112 within the side wall 114 of the tubular member 102. The slot 112 includes a first end 116 positioned at the first end 104 of the tubular member 102, and a second end 120 positioned slightly ahead of the midpoint 122 of the tubular member 102 (FIG. 2).

Positioned partially within the bore 110 of the tubular member 102 is a rod 130. The rod 130 has a first section 132 which is located entirely within the bore 110 as shown in FIG. 1. The first section 132 of the rod 130 has a diameter "A" (FIG. 6) which is less than the diameter "B" of the bore 110 (FIG. 2). This enables the first section 132 to freely move within the bore 110. The first section 132 further includes an inner end 136, and outer end 138 shown in FIG. 1. The outer end 138 consists of a flattened section 140 having an opening 142 therethrough. The opening 142 is sized to receive the first end 146 of a biasing member preferably in the form of a coil spring 150 which is movably positioned within the bore 110 of the tubular member 102. The coil spring has a diameter "C" (FIG. 1) which is less that the diameter "B" of the bore 110. This enables the spring 150 to freely move within the bore 110. The spring 150 also includes a second end 152 which is positioned within an opening 154 in a plug member 160. The plug member 160 is fixedly secured within the second end 106 of the tubular member 102. The spring 150 is used to bias the rod 130 toward the second end 106 of the tubular member 102, as described in greater detail below.

With continued reference to FIG. 1, the rod 130 also includes a second section 170 which extends outwardly from the inner end 136 of the first section 132 at an angle "X" (FIG. 1) of about 90 degrees. The second section 170 is designed to pass outwardly through the slot 112 and move freely therein as shown in FIGS. 1–2.

The second section 170 has an inner end 180, an outer end 182, and a medial portion 184 therebetween (FIG. 1). In a preferred embodiment shown in FIG. 6, the outer end 182 and medial portion 184 have the same diameter "D" which is greater than the width "E" (FIG. 2) of the slot 112. However, the inner end 180 includes two notches 190, 192 therein which are parallel to each other, and parallel to the longitudinal axis "F" of the tubular member 102. The notches 190, 192 are adapted to slidably receive longitudinal edges 194, 196 of the slot 112 therein (FIG. 2). This configuration enables the second section 170 of the rod 130 to slide inwardly along the slot 112, even though the diameter "D" of the outer end 182 and medial portion 184 exceed the width "E" of the slot 112.

In an alternative embodiment shown in FIG. 7, the configuration of the second section 170 is the same as that shown in FIG. 6, except for the absence of the notches 190, 192. Instead, the inner end 180 is uniformly narrowed and circular in cross-section. Specifically, the diameter "G" of the inner end 180 in the embodiment of FIG. 7 is less than the width "E" of the slot 112 in order to allow inward movement of the second section 170 of the rod 130 along the slot 112 as described above.

A further alternative embodiment of the second section 170 of the rod 130 is shown in FIG. 8. In this embodiment, the entire second section 170 of the rod 130 (including the inner end 180, outer end 182 and medial portion 184) have a uniform diameter "H" which is less than the width "E" of the slot 112. Again, this enables the second section 170 of the rod 132 to move freely along the slot 112.

With reference to FIG. 2, it is not possible to laterally remove the rod 130 from the slot 112 (e.g. in the direction of arrow 200). This is due to the greater diameter "A" of the first section 132 compared with the width "E" of the slot 112. To prevent the rod 130 from being pulled axially outward from the bore 110 (e.g. in the direction of arrow 202 in FIG. 1) stop means are provided. The stop means consists of a stop member 204 illustrated in FIG. 2 and positioned at the first end 104 of the tubular member 102. The stop member 204 includes a first section 206 secured by welding or the like to the first end 104 of the tubular member 102. Also included is a second section 210 which forms an angle "Y" of about 90 degrees relative to the first section 206. As shown in FIG. 2, the second section 210 extends outwardly from the first end 10 of the tubular member 102 at a distance "I" which is greater than the diameter of the outer end 182, inner end 180 and medial portion 184 of the second section 170 of the rod 130, regardless of which embodiment is involved. The utility of this configuration will be described in greater detail below.

Finally, the chain guide unit 100 includes dual mounting brackets 220, 222 having openings 224, 226 therethrough which are used to attach the unit 100 in position beneath the platform 11 as illustrated in FIGS. 3–5. A variety of different known fasteners may be used to secure the unit 100 in position (e.g., bolts or the like). In addition, the basic configuration, shape, and quantity of the mounting brackets may be suitably varied, depending the particular pipe vise with which the present invention is used. In the presently illustrated embodiment, the chain guide unit 100 is attached to and in front of the legs 12, 13 directly beneath the platform 11. As a result, the second end 76 of the chain 52 is suspended adjacent the slot 112 in the tubular member 102, and between the second section 170 of the rod 130 and the second end 120 of the slot 112 as shown in FIG. 3.

OPERATION

The chain guide unit 100 of the present invention is shown in a pre-operative condition in FIGS. 1 and 3. Basically, the second section 170 of the rod 130 is in an downward position as shown in FIG. 1. The second section 170 is then rotated approximately 90 degrees upward. Rotation of the second section 170 in this manner is possible because the distance "I" between the first end 104 of the tubular member 102 and the second section 21 of the stop member 204 is greater than the diameter of the second section 170 as previously discussed.

Rotation of the second section 170 in the foregoing manner causes the notches 190, 192 to become aligned with the longitudinal edges 194, 196 of the slot 112. As a result, the second section 170 is able to slide inwardly along the slot 112 through the biasing action of the spring 150. As the second section 170 moves inwardly, it engages the portion 78 of the second end 76 of the chain 52, and urges one of the links 54 thereof into the open zone 24 for engagement of the outwardly-extending pins 56 of the selected link 54 with the engagement members 26, 27 as previously described. The chain 52 is then tightened by rotation of the handle 60 of the crank mechanism 58.

Use of the chain guide unit of the present invention enables a chain-type pipe vise to be efficiently operated without manual manipulation of the chain. As a result, the overall operating efficiency and safety of the pipe vise is improved. Thus, the present invention clearly represents an advance in pipe-handling technology.

Having herein described a preferred embodiment of the present invention, it is anticipated that suitable modifications may be made thereto by individuals skilled in the art within the scope of the invention. Thus, the scope of the invention shall only be construed in accordance with the following claims:

I claim:

1. A chain guide unit for a pipe vise having a base member, a plurality of V-shaped members on said base member for receiving a pipe, and a retaining chain sized to encircle said pipe when positioned against said V-shaped members, said unit comprising:

a tubular member having a first end, a second end, and a bore therethrough extending continuously from said first end to said second end, said tubular member further comprising an elongate slot therein extending from said first end inwardly and terminating between said first end and said second end;

a rod having a first section and a second section, said first section being positioned within said bore of said tubular member, said first section having a diameter less than that of said bore so as to allow said first section to move freely therein, said second section extending outwardly from said first section at an angle thereto and passing outwardly through said slot, said second section being movable within said slot, the movement of said first section causing said second section to move longitudinally through said slot; and biasing means for pulling said second section of said rod inwardly along said slot toward said second end of said tubular member, said biasing means comprising a spring member having a first end and a second end, said first end of said spring member being operatively connected to said first section of said rod, and said second end of spring member being operatively connected to said second end of said tubular member.

2. The chain guide unit of claim 1 wherein said first end of said tubular member has an opening therein, said opening providing access to said bore through said tubular member.

3. The chain guide unit of claim 2 further comprising stop means for preventing the accidental removal of said rod from said tubular member through said first end thereof.

4. The chain guide unit of claim 3 wherein said stop means comprises an engagement member secured to said tubular member at said first end thereof, said engagement member being positioned over said first end of said tubular member in order to prevent the removal of said rod therefrom.

5. The chain guide unit of claim 4 wherein said engagement member comprises a first portion secured to said first end of said tubular member, and a second portion extending outwardly from said first portion at about a 90 degree angle relative thereto, said second portion being positioned over said opening in said first end and spaced outwardly therefrom at a distance greater than the diameter of said second section of said rod.

6. The chain guide unit of claim 1 wherein said second end of said tubular member further comprises a plug member fixedly secured thereto, said second end of said spring member being secured to said plug member.

7. The chain guide unit of claim 1 wherein said first section of said rod and said second section of said rod form an angle of about 90 degrees relative to each other.

8. The chain guide unit of claim 1 wherein said first section of said rod has a diameter which is greater than the width of said slot.

9. The chain guide unit of claim 1 wherein said second section of said rod has a uniform diameter which is smaller than the width of said slot so as to allow the passage of said second section therethrough.

10. A chain guide unit for a pipe vise having a base member, a plurality of V-shaped members on said base member for receiving a pipe, and a retaining chain sized to encircle said pipe when positioned against said V-shaped members, said unit comprising:

a tubular member having a first end, a second end, and a bore therethrough extending continuously from said first end to said second end, said first end having an opening therein, said opening providing access to said bore, said tubular member further comprising an elongate slot therein extending from said first end inwardly and terminating between said first end and said second end, said second end of said tubular member further comprising a plug member fixedly secured thereto;

a rod having a first section and a second section, said first section and said second section of said rod forming an angle of about 90 degrees relative to each other, said first section being positioned within said bore of said tubular member and having a diameter greater than said the width of said slot and less than the diameter of said bore so as to allow said second section to move freely within said bore, said second section extending outwardly from said first section at said angle and passing outwardly through said slot, said second section being movable within said slot, the movement of said first section within said bore causing said second section to move longitudinally along said slot;

biasing means for pulling said second section of said rod inwardly along said slot toward said second end of said tubular member, said biasing means comprising a spring member having a first end and a second end, said first end of said spring member being operatively connected to said first section of said rod and said second end of spring member being operatively connected to said plug member at said second end of said tubular member; and stop means for preventing the accidental removal of said rod from said tubular member through said first end of said tubular member, said stop means comprising an engagement member secured to said tubular member at said first end thereof, said engagement member being positioned over said first end of said tubular member in order to prevent the removal of said rod therefrom, said engagement member comprising a first portion secured to said first end of said tubular member, and a second portion extending outwardly from said first portion at an angle of about 90 degrees relative thereto, said second portion being positioned over said opening in said first end of said tubular member and spaced outwardly therefrom at a distance greater than the diameter of said second section of said rod.

11. A pipe vise apparatus comprising:

a base member;

a plurality of V-shaped members on said base member for receiving a pipe;

a retaining chain sized to encircle said pipe when positioned against said V-shaped members, said chain having a first end operatively attached to said base member and a second end, said second end being suspended in a downward orientation beneath said base member after said chain has encircled said pipe;

attachment means operatively secured to said base member for receiving said second end of said chain and retaining said second end therein in order to maintain said chain in position around said pipe after said pipe has been positioned on said V-shaped members; and a chain guide unit secured to and beneath said base member for automatically positioning said second end of said chain within said attachment means comprising:

a tubular member having a first end, a second end, and a bore therethrough extending continuously from said first end to said second end, said tubular member further comprising an elongate slot therein extending from said first end inwardly and terminating between said first end and said second end;

a rod having a first section and a second section, said first section being positioned within said bore of said tubular member, said first section having a diameter less than that of said bore so as to allow said first section to move freely therein, said second section extending outwardly from said first section at an angle thereto and passing outwardly through said slot, said second section being movable within said slot, the movement of said first section causing said second section to move longitudinally through said slot; and biasing means for pulling said second section of said rod inwardly along said slot toward said second end of said tubular member.

12. The pipe vise apparatus of claim 11 wherein said first end of said tubular member of said chain guide unit has an opening therein, said opening providing access to said bore through said tubular member.

13. The pipe vise apparatus of claim 12 wherein said chain guide unit further comprises stop means for preventing the accidental removal of said rod from said tubular member through said first end thereof.

14. The pipe vise apparatus of claim 13 wherein said stop means comprises an engagement member secured to said tubular member at said first end thereof, said engagement member being positioned over said first end of said tubular member in order to prevent the removal of said rod therefrom.

15. The pipe vise apparatus of claim 14 wherein said engagement member comprises a first portion secured to said first end of said tubular member, and a second portion extending outwardly from said first portion at about a 90 degree angle relative thereto, said second portion being positioned over said opening in said first end and spaced outwardly therefrom at a distance greater than the diameter of said second section of said rod.

16. The pipe vise apparatus of claim 11 wherein said biasing means of said chain guide unit comprises a spring member having a first end and a second end, said first end of said spring member being operatively connected to said first section of said rod, and said second end of spring member being operatively connected to said second end of said tubular member.

17. The pipe vise apparatus of claim 16 wherein said second end of said tubular member further comprises a plug member fixedly secured thereto, said second end of said spring member being secured to said plug member.

18. The pipe vise apparatus of claim 11 wherein said first section of said rod and said second section of said rod of said chain guide unit form an angle of about 90 degrees relative to each other.

19. The pipe vise apparatus of claim 11 wherein said first section of said rod of said chain guide unit has a diameter which is greater than the width of said slot.

20. The pipe vise apparatus of claim 11 wherein said second section of said rod of said chain guide unit comprises an inner end, an outer end, and a medial portion therebetween, said inner end being sized for the slidable movement thereof through said slot, said medial portion and said outer end having a diameter which is greater than the width of said slot.

21. The pipe vise apparatus of claim 11 wherein said second section of said rod of said chain guide unit has a uniform diameter which is smaller than the width of said slot so as to allow the passage of said second section therethrough.

22. A pipe vise apparatus comprising:

a base member;

a plurality of V-shaped members on said base member for receiving a pipe;

a retaining chain sized to encircle said pipe when positioned against said V-shaped members, said chain having a first end operatively attached to said base member and a second end, said second end being suspended in a downward orientation beneath said base member after said chain has encircled said pipe;

attachment means operatively secured to said base member for receiving said second end of said chain and retaining said second end therein in order to maintain said chain in position around said pipe after said pipe has been positioned on said V-shaped members; and a chain guide unit secured to and beneath said base member for automatically positioning said second end of said chain within said attachment means comprising:

a tubular member having a first end, a second end, and a bore therethrough extending continuously from said first end to said second end, said first end having an opening therein, said opening providing access to said bore, said tubular member further comprising an elongate slot therein extending from said first end inwardly and terminating between said first end and said second end, said second end of said tubular member further comprising a plug member fixedly secured thereto;

a rod having a first section and a second section, said first section and said second section of said rod forming an angle of about 90 degrees relative to each other, said first section being positioned within said bore of said tubular member and having a diameter greater than said the width of said slot and less than the diameter of said bore so as to allow said first section to move freely within said bore, said second section extending outwardly from said first section at said angle and passing outwardly through said slot, said second section being movable within said slot, the movement of said first section within said bore causing said second section to move longitudinally along said slot;

biasing means for pulling said second section of said rod member inwardly along said slot toward said second end of said tubular member, said biasing means comprising a spring member having a first end and a second end, said first end of said spring member being operatively connected to said first section of said rod and said second end of spring member being operatively connected to said plug member at said second end of said tubular member; and stop means for preventing the accidental removal of said rod from said tubular member through said first end of said tubular member, said stop means comprising an engagement member secured to said tubular member at said first end thereof, said engagement member being positioned over said first end of said tubular member in order to prevent the removal of said rod therefrom, said engagement member comprising a first portion secured to said first end of said tubular member, and a second portion extending outwardly from said first portion at an angle of about 90 degrees relative thereto, said second portion being positioned over said opening in said first end of said tubular member and spaced outwardly therefrom at a distance greater than the diameter of said second section of said rod.

23. A chain guide unit for a pipe vise having a base member, a plurality of V-shaped members on said base member for receiving a pipe, and a retaining chain sized to encircle said pipe when positioned against said V-shaped members, said unit comprising:

a tubular member having a first end, a second end, and a bore therethrough extending continuously from said first end to said second end, said tubular member further comprising an elongate slot therein extending from said first end inwardly and terminating between said first end and said second end;

a rod having a first section and a second section, said first section being positioned within said bore of said tubular member, said first section having a diameter less than that of said bore so as to allow said first section to move freely therein, said second section extending outwardly from said first section at an angle thereto and passing outwardly through said slot, said second section comprising an inner end, an outer end, and a medial portion therebetween, said inner end being sized for the slidable movement thereof through said slot, said medial portion and said outer end having a diameter which is greater than the width of said slot; and biasing means for pulling said second section of said rod inwardly along said slot toward said second end of said tubular member.

* * * * *